United States Patent [19]

Wood

[11] 4,336,878

[45] Jun. 29, 1982

[54] ARTICLE CARRIER HAVING IMPROVED LOCKING MEANS

[75] Inventor: Prentice J. Wood, Hapeville, Ga.

[73] Assignee: The Mead Corporation, Dayton, Ohio

[21] Appl. No.: 193,783

[22] Filed: Oct. 3, 1980

[51] Int. Cl.[3] ..... B65D 5/48; B65D 75/00

[52] U.S. Cl. ..... 206/173; 206/188; 229/52 BC

[58] Field of Search ..... 206/171, 172, 173, 188; 229/52 BC

[56] References Cited

U.S. PATENT DOCUMENTS

| | | | |
|---|---|---|---|
| 3,027,815 | 4/1962 | Anness et al. | 93/53 |
| 3,572,542 | 3/1971 | Wood et al. | 206/173 |
| 3,757,991 | 9/1973 | Stout | 206/173 |
| 4,029,205 | 6/1977 | Wood | 206/173 |
| 4,153,158 | 5/1979 | Graser et al. | 206/173 |

FOREIGN PATENT DOCUMENTS

| | | | |
|---|---|---|---|
| 936503 | 11/1973 | Canada | 206/173 |

*Primary Examiner*—Joseph Man-Fu Moy
*Attorney, Agent, or Firm*—Erwin Doerr

[57] ABSTRACT

An article carrier of the basket type having locking tabs in the lower portions of riser panels at both ends of the carrier which are engaged by the carrier bottom panel to maintain the carrier in squared set-up condition. The locking tabs and the cooperating parts of the bottom panel are sized and positioned such that displacement of a carrier end wall to engage one tab causes simultaneous displacement of the opposite end wall by an amount sufficient just to clear the opposite locking tab from the bottom panel so that complete locking occurs when the displacement force is relieved.

5 Claims, 3 Drawing Figures

ARTICLE CARRIER HAVING IMPROVED LOCKING MEANS

This invention relates to a cellular article carrier of the basket-style which is fabricated from a single blank of flexible sheet material, the blank being cut and creased so that it is divided into a number of panels which thereafter are folded and secured in a predetermined relationship with respect to one another so as to provide an article carrier having a plurality of article accommodating cells.

In order to facilitate loading of articles into the cells of such a carrier and to provide for stability when the empty carrier is free-standing, it is important to ensure that the carrier is set up in a squared and secure condition. To this end, it is known to form locking tabs in the lower portions of riser panels at both ends of the carrier to be engaged in notches provided in the bottom panel of the carrier. Typical examples of the prior art are shown in U.S. patents to Anness et al No. 3,027,815 (FIGS. 22 and 23) and Wood et al No. 3,572,542. However, such known "double lock" arrangements are either difficult to engage or, if arranged so as to facilitate the locking engagement of the bottom panel, do not always hold the carrier in a secure and fully locked condition.

According to one aspect of this invention, there is provided a cellular article carrier of the basket-style comprising a bottom panel (1), opposed sidewalls (2, 2*a*) foldably joined to opposite side edges of said bottom panel, end panels (7, 8) foldably joined to the ends of said sidewalls and extending transversely inward therefrom, medial riser panels (5, 6) foldably joined to said end panels respectively, locking means (A, B) formed in said riser panels adjacent the lower ends thereof at each end of the carrier for respectively recriving cooperating locking means (15, 16) provided in the bottom panel so as to hold the carrier in squared, set-up condition, characterized in that the relative dimensions of the locking means are such that when one riser panel locking means (A) is caused fully to engage its cooperating bottom panel locking means (16) during inward displacement of said one riser panel (6), the other riser panel locking means (B) simultaneously is caused to clear its cooperating other bottom panel locking means (15) by an amount necessary to achieve locking cooperation between said other locking means (B, 15) when said inward displacement is ceased.

According to another aspect of this invention there is provided a cellular article carrier of the basket-style comprising a bottom panel (1), opposed sidewalls (2, 2*a*) foldably joined to opposite side edges of said bottom panel, end panels (7, 8) foldably joined to the ends of said sidewalls and extending transversely inward therefrom, medial riser panels (5, 6) foldably joined to said end panels respectively, a locking tab (A, B) formed in said riser panels adjacent the lower ends thereof at each end of the carrier, each tab having a recessed throat portion (9, 11) and a projecting toe portion (10, 12) for respectively engaging in a cooperating notch (15, 16) adjacent an end edge of said bottom panel so as to hold the carrier in squared set-up condition, characterized in that the direct distance (X) between the innermost part of the toe portion of one locking tab (B) and the outermost part of the throat of the opposite locking tab (A) is no smaller than the distance between said cooperating interior edges of notches (15, 16) of the bottom panel.

For a better understanding of the invention, reference is now made to the following detailed description taken in conjunction with the accompanying drawings, in which.

Figure 1:
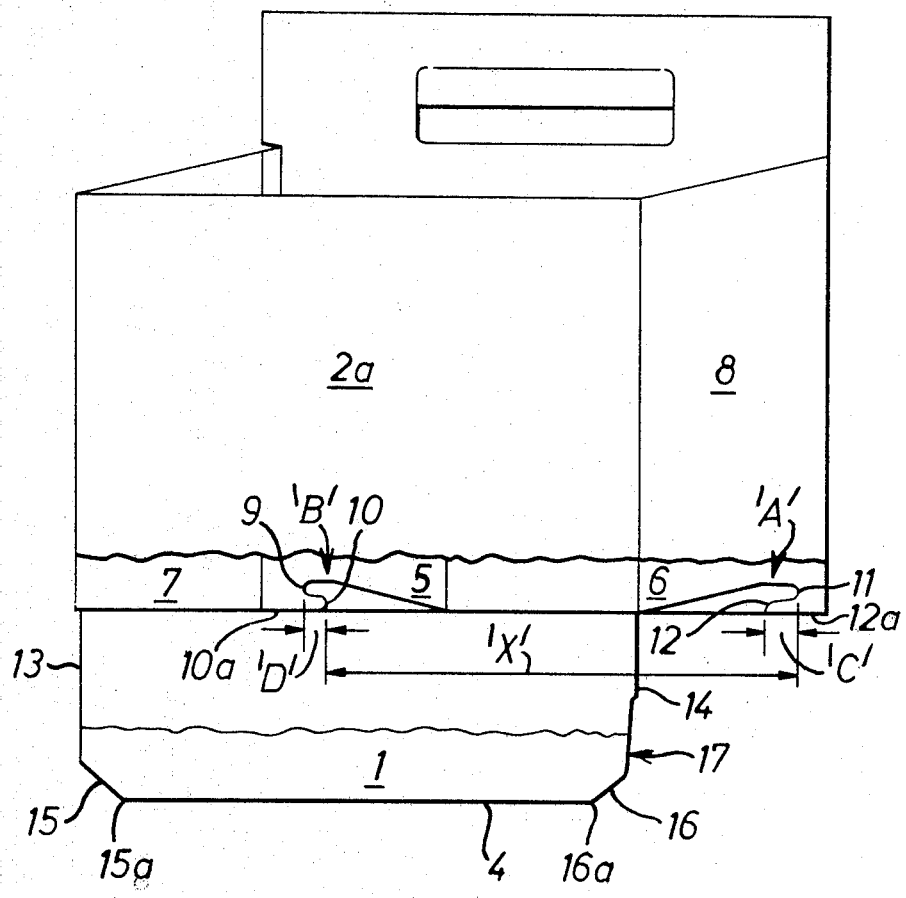
FIG. 1 is a plan view, in part section, of a basket-style carrier shown in its collapsed condition.

In the drawings, the numeral 1 designates the bottom panel of a basket-style carrier, the bottom panel being hinged to one of the carrier sidewalls 2 and joined to the opposite carrier sidewall 2*a* by means of a glue flap 3 hinged thereto. The bottom panel 1 has a central fold line 4 along which the bottom panel is folded into two overlapping sections when the carrier is in its collapsed condition as shown in FIG. 1.

As is well known in the art, the carrier comprises a pair of internal riser panels 5 and 6 (FIG. 1) extending medially inwardly from opposite ends of the carrier and being hinged to foldable end walls 7 and 8 respectively. The riser panel 5 is formed at its lower end with a locking tab "B" which comprises a throat 9 formed by a recessed portion of the innermost edge of the riser panel 5 and an inwardly extending toe 10 at the base of the riser panel. The lowermost portion of the riser panel 5 provides a foot 10*a* of the locking tab "B". The length of the foot 10*a* between the throat 9 and the toe 10 is designated dimension "D". Similarly, the riser panel 6 is formed at its lower end with a locking tab "A" provided with a throat 11, a toe 12 and a foot 12*a*. However, in this case the recess providing throat 11 of the locking tab "A" is deeper than the recess providing the throat 9 of locking tab "B". In other words, the throat 11 is located further towards the adjacent end wall 8 of the carrier. The length of the foot 12*a* between the throat 11 and the toe 12 is designated dimension "C".

In order to cooperate with the locking tabs "A" and "B" so as to maintain the carrier in a squared set-up condition, the bottom panel 1 of the carrier has end edges 13, 14 which are each formed with a central V-shaped notch 15, 16, respectively. In both instances, the apices of the notches 15, 16 are interconnected by the central fold line 4. The notch 15 is struck from the end edge 13 of the bottom panel and the depth of the notch, i.e. the distance between its mouth at end edge 13 and its apex 15*a*, is substantially equal to the distance along riser panel 5 between the throat 9 of the locking tab "B" and the adjacent end wall 7 of the carrier. In the case of V-shaped notch 16 it will be seen that the notch depth, i.e. the distance between its mouth and its apex, is smaller than that of notch 15. This is because the notch 16 is struck from a recessed zone 17 formed centrally along end edge 14 by a pair of shallow, inwardly divergent edges 18, 19, respectively. Thus, the mouth of notch 16 is set back from the end edge 14 so as to facilitate the locking procedure as described shortly. The cooperating part of the riser panel is correspondingly smaller in that the throat 11 of locking tab "A" is positioned closer to the adjacent end wall 8 of the carrier than is the case with throat 9 of tab "B". This is achieved by recessing into the riser panel 6 further so as to produce a larger toe to throat dimension "C".

The resulting arrangement of these dimensions is such that the total length of the central fold line 4, i.e. the distance between the apices 15*a*, 16*a* of the notches 15, 16, is equal to or slightly less than the distance between the innermost point of the toe 10 of locking tab "B" and the outermost point of the throat 11 of locking tab "A". This dimension is designated "X" in FIG. 1 of the drawings.

Figure 2:
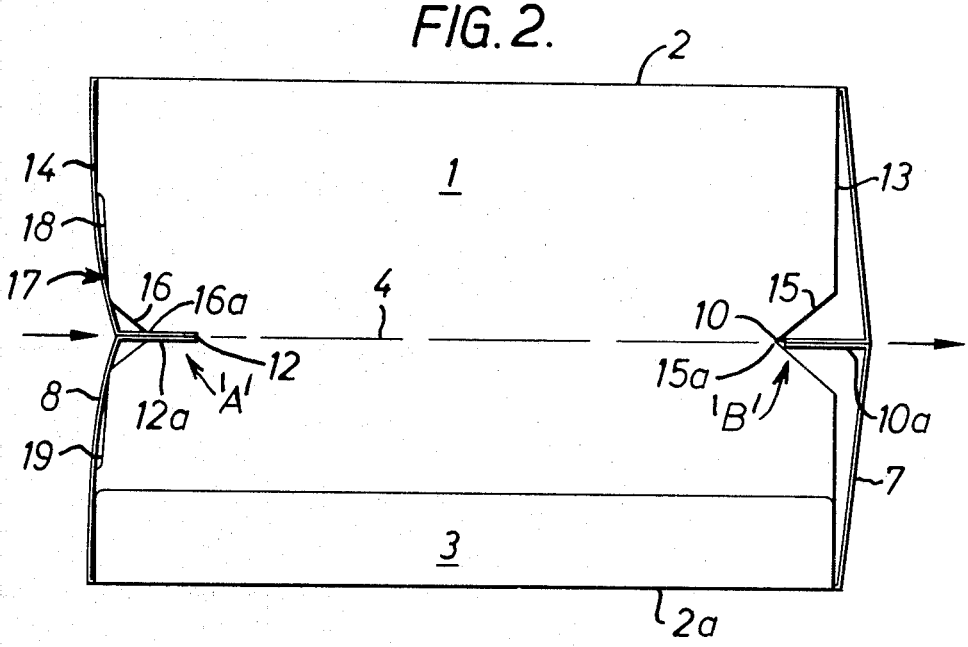
FIG. 2 is a view of the underside of the same carrier showing the bottom panel engaged with one of the locking tabs.
Figure 3:
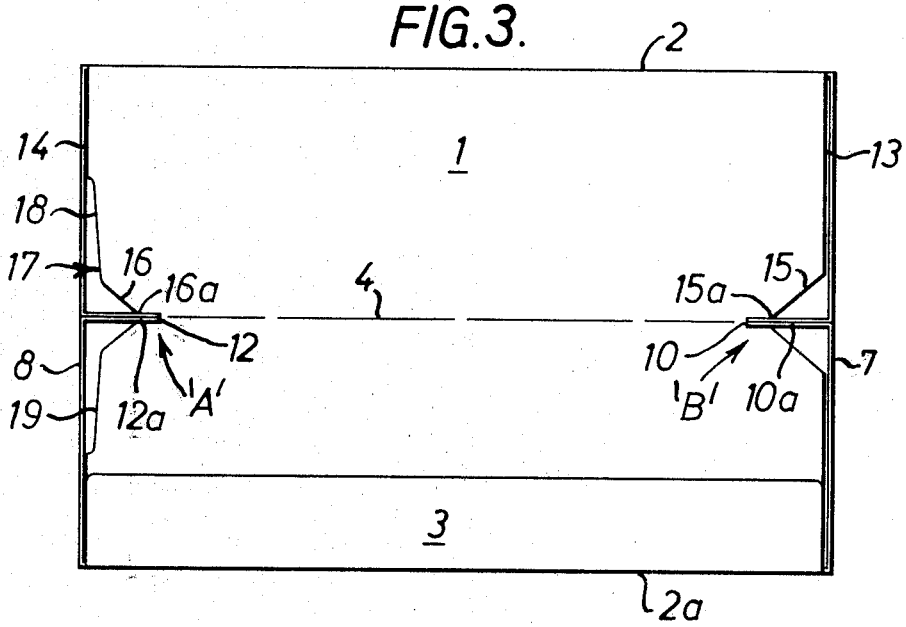
FIG. 3 is a view of the underside of the same carrier after the locking operation has been completed.

The locking of the bottom panel 1 of the locking hooks is effected during the setting-up operation of the carrier as follows. During the opening sequence of the carrier from its collapsed condition when the carrier sidewalls 2, 2*a* are being moved apart from one another, an inward pressure is applied to the bottom panel 1 immediately before the carrier has fully opened so as to case the notch 16 to be engaged within the throat 11 of locking tab "A". In order to fully locate the notch 16 and locking tab "A", force is applied to the adjacent end wall 8 of the carrier so that it is moved inwardly until portions of the inside face of wall 8 abut the converging edges 18 and 19 of the central recessed zone 17. Thus, the apex 16*a* of notch 16 will be fully engaged within the throat 11 of the tab "A". As described above, the dimensions of the throat 11 and of the notch depth of notch 16 are specifically sized such that upon maximum entry of the notch 16 into the throat locking tab "A", the end wall 7 simultaneously is displaced outwardly relative to end edge 13 an amount sufficient to allow the toe 10 of locking tab "B" just to clear the apex 15*a* of the cooperating notch 15. This condition is illustrated in FIG. 2. The bottom panel is then caused to be moved inwardly and sideways force relieved so that the carrier is relaxed, whereby notch 15 is brought into engagment with the locking tab "B". In so doing the apex 16*a* of notch 16 will move relative to the toe 12 of locking tab "A" so that the bottom panel 1 is centralized and retained by the locking tabs "A" and "B". This final locking condition of the carrier is illustrated in FIG. 3.

It is not essential that the distances "C" and "D" of the locking tabs "A" and "B" are of different dimensions since it is quite conceivable, althrough unnecessary, that the throat of the lock "B" may be extended so that the dimension "D" equals dimension "C". Naturally, in order for correct locking to be effected it is essential that the dimensional relationships are chosen such that the end wall of the carrier having the locking tab first to be engaged can be displaced inwardly by an amount which is sufficient to cause enough outward dislacement of the opposite carrier end wall so that the locking tab carried thereby can just clear its associated notch. Thus, when the displacement pressure is relieved so that the carton can relax, the second locking tab will engage the bottom panel 1.

By this invention easy setting-up operations are afforded and at the same time the locking tabs are arranged so as to hold the carrier in a secure locked condition against inadvertent unlocking particularly during intial loading of the carrier. Thus, a carrier is provided which is securely locked at both ends and which therefore is necessarily set up in a squared and secured condition so that it is not subject to being easily toppled inadvertently.

The embodiments of the invention in which an exclusive property or privilege is claimed are defined as follows:

1. A cellular article carrier of the basket-style comprising a bottom panel (1), opposed sidewalls (2, 2*a*) foldably joined to opposite side edges of said bottom panel, end panels (7, 8) foldably joined to the ends of said sidewalls and extending transversely inward therefrom, medial riser panels (5, 6) foldably joined to said end panels respectively, locking means (A, B) formed in said riser panels adjacent the lower ends thereof at each end of the carrier for respectively receiving cooperating locking means (15, 16) provided by the bottom panel so as to hold the carrier in squared, set-up condition, characterized in that the relative dimensions of the locking means are such that when one riser panel locking means (A) is caused fully to engage its cooperating bottom panel locking means (16) during inward displacement of said one riser panel (6), the other riser panel locking means (B) simultaneously is caused to clear its cooperating other bottom panel locking means (15) by an amount necessary to achieve locking cooperation between said other locking means (B, 15) when said inward displacement is ceased.

2. The cellular article carrier according to claim 1 characterized in that said cooperating locking means comprise V-shaped notches (15, 16) struck from opposite end edges (13, 14) of the bottom panel (1).

3. The cellular article carrier according to claim 2 characterized in that one of said notches (16) is struck from a recessed zone (17) formed centrally along one of said end edges (14), the recessed zone being provided by a pair of shallow inwardly divergent edges (18, 19) terminating at the mouth of said one notch whereby said notch mouth is set back inwardly of said end edges (14).

4. The cellular article carrier according to claim 3 characterized in that the depth of said one notch (16) between its apex and its mouth is less than the depth of said other notch (15), said notch depth in each case being substantially equal to the distance along the riser panel between the outermost part of the throat and the adjacent carrier end wall of the respective locking tabs (A, B).

5. The cellular article carrier according to claim 4 characterized in that the distance between the apices of said V-notches (15, 16) in the bottom panel (1) is slightly less than the distance between the innermost part of the toe (10) at one locking tab (B) and the outermost part of the throat (11) on the other locking tab (A).

* * * * *